US005886310A

United States Patent [19]

Kataoka et al.

[11] Patent Number: 5,886,310

[45] Date of Patent: Mar. 23, 1999

[54] ROTARY-OPERATION TYPE ELECTRONIC COMPONENT WITH PUSH SWITCH

[75] Inventors: Kenji Kataoka; Jun Sato; Tetsuya Fukuda, all of Tsuyama, Japan

[73] Assignee: Matsushita Electric Industrial Co., Ltd., Osaka, Japan

[21] Appl. No.: 62,751

[22] Filed: Apr. 20, 1998

[30] Foreign Application Priority Data

Apr. 21, 1997 [JP] Japan ..... 9-102970
Oct. 28, 1997 [JP] Japan ..... 9-295112

[51] Int. Cl.[6] ..... H01H 19/20

[52] U.S. Cl. ..... 200/14; 200/4; 200/18

[58] Field of Search ..... 200/4, 5 R, 6 R, 200/6 A, 6 C, 11 R, 14, 11 D, 11 J, 11 K, 16 R–16 D, 329, 330, 336, 341, 18, 564–572

[56] References Cited

U.S. PATENT DOCUMENTS 4,107,500 8/1978 Distler et al. ..... 200/308
5,180,050 1/1993 Rada et al. ..... 200/329
5,593,023 1/1997 Kaizaki et al. ..... 200/570
5,613,600 3/1997 Yokoji et al. ..... 200/564
5,705,778 1/1998 Matsui et al. ..... 200/11 R
5,711,415 1/1998 Fukuda et al. ..... 200/570

FOREIGN PATENT DOCUMENTS 08203387 9/1996 Japan ..... H01H 25/00

*Primary Examiner*—Michael A. Friedhofer
*Attorney, Agent, or Firm*—McDermott, Will & Emery

[57] ABSTRACT

Revolving contact-points board (2) is provided with a ring contact-point (8) sand a radial contact-point (9) on the bottom surface, while fitting substrate (1) is provided with an elastic contact-point 11 for switch and elastic contact-points (13, 14) for revolution signal. Underneath the fitting substrate (1), a sliding plate (7) made of an elastic metal sheet is provided for regulating the movement in horizontal direction of the revolving contact-points board 2. With a push of the round operation knob (3) fixed on the revolving contact-points board (2) in the horizontal direction, the ring contact-point (8) makes contact with the contact-point (11) to generate a switch signal. With a revolution of the operation knob (3), the radial contact-point (9) makes contact with the contact-points (13, 14) to generate a pulse signal.

14 Claims, 16 Drawing Sheets

ROTARY-OPERATION TYPE ELECTRONIC COMPONENT WITH PUSH SWITCH

BACKGROUND OF THE INVENTION

The present invention relates to a rotary-operation type electronic component incorporating a push switch, for use in a mouse or other computer peripherals, portable telephones, pagers, etc.

The rotary-operation type electronic component with push switch is an electronic component comprising a single operation knob which can operate the rotary electronic component section and the push-switch section separately. As an example of such electronic components, a rotary encoder with push switch disclosed in Japanese Patent Application Unexamined Publication No.08-203387 is described in the following with reference to FIG.16–FIG.21.

The conventional rotary encoder with push switch comprises a rotary encoder 32 and a push switch 33 disposed on a resin-made fitting substrate 31 having feet 31A and 31B. The encoder 32 is attached movable for a certain distance in a predetermined horizontal direction (the direction H2) on the fitting substrate 31, and the switch 33 is fixed on the same fitting substrate 31.

The flat plate-shaped fitting substrate 31 is provided with a cavity area 35 comprising guide rails 34 for guiding the encoder 32 in the horizontal direction, a hollow 37 having stop wall 36 for fixing the switch 33, and terminal boards 39 having terminals 38 for transmitting electric signals from encoder 32 outside.

The encoder 32 comprises a box-shaped case 40 made of resin placed in the cavity area 35 to be guided by the guide rails 34, a resin-made rotary disk 46 affixed revolvable to a pillar shaft 43 at the center of the boxshaped case 40, and an operation knob 50 fixed to the rotary disk 46 with a screw 49. An elastic contacting body 56 having upper contact-points 41 and lower contact-points 42 protruding in the respective directions is fixed by insert-molding in the bottom of the box-shaped case 40, and a clicking spring 48 is fixed at the top. A radial contact disk 44 is fixed at the bottom of rotary disk 46, the upper surface of which disk 46 is provided with a radially bumping surface 45. As shown in FIG. 19, a dowel 47A of elastic foot 47 of clicking spring 48 rests in an indent 45A of the bumping surface 45. The upper contact-point 41 makes contact with radial contact disk 44, while the lower contact-point 42 makes contact with terminal board 39 of fitting substrate 31.

As shown in FIG.20 and FIG.21, a coil spring 52 is attached to a pin 51 protruding from fitting substrate 31 so as to push the box-shaped case 40 at the side. Therefore, the encoder 32 is usually staying away from the switch 33.

As shown in FIG.18, the switch 33 is fixed in the hollow 37 of fitting substrate 31 with the button 53 facing to the encoder 32 and the rear end touching the stop wall 36. A driving rod 54 being a part of the box-shaped case 40 is touching the button 53 of switch 33.

Operation of the conventional rotary encoder with push switch is described in the following.

The rotating operation is described in the first place. When the operation knob 50 is applied at the outer circumferential edge 50A with a force in the tangential direction, as shown in FIG.20, to have the operation knob 50 revolved, the rotary disk 46 revolves around the pillar shaft 43, and the upper contact-points 41 slide on the radial contact disk 44. As a result, a pulse signal is generated in accordance with the revolution of operation knob 50, and the dowel 47A resting in the indent 45A of bumping surface 45 moves on the bumping surface 45 accompanying a click feeling to the next indent, which indent representing the next stop position. The pulse signal is transmitted via upper contact-points 41 and lower contact-points 42 to the terminal board 39, to be conveyed to a circuit of an electronic appliance through the terminals 38 for external connection.

Now in the following, the push operation is described. When a horizontal force is applied to the operation knob 50 at the edge 50A in the direction connecting the center of operation knob 50 and the switch 33 (direction of an arrow H2), as shown in FIG.21, against the elastic force of spring 52, the encoder 32 moves along the guide rails 34 towards switch 33. The driving rod 54 pushes the button 53 and the switch 33 operates, thereby a signal is transmitted to a circuit of an electronic appliance via connection terminal 55. As soon as the force on operation knob 50 is removed, the encoder 32 is pushed-back to the front by the elastic restoring force of coil spring 52 to the initial position as shown in FIG. 20.

In the above rotary encoder, unwanted move of operation knob 50 during the push operation on the switch 33 is prevented by setting the dowel 47A of clicking spring 48 in an indent 45A of the bumping surface 45.

However, the above described conventional rotary encoder incorporating push switch carries with it following drawbacks. Namely, because an encoder 32 and a switch 33 are disposed respectively as independent blocks on the upper surface of fitting substrate 31, the overall length from the edge 50A of operation knob 50 to the rear end of switch 33 becomes very long. As the encoder 32 is comprised of a box-shaped case 40, a rotary disk 46, a clicking spring 48 and an operation knob 50 piled up one after another, the height also becomes substantial. Furthermore, an entire push-switch is used for the switch 33, and the terminal boards 39, the elastic contact body 56, the clicking spring 48, the coil spring 52 and other pieces are formed as the independent member from respective metal materials; which means the high manufacturing cost of finished components.

SUMMARY OF THE INVENTION

An object of the present invention is to provide a compact and inexpensive rotary-operation type electronic component incorporating a push switch.

A rotary-operation type electronic component of the present invention comprises a revolving contact-points board provided with a plurality of contact-points disposed radially on the bottom surface and having a center hole at the center; an operation knob for operating the revolving contact-points board; a fitting substrate having an elastic contact-point for generating revolution signal which makes contact with the plurality of contact-points by the revolution of the revolving contact-points board and generates a signal, an elastic contact-point for switch signal which makes contact with the plurality of contact-points by the horizontal shift of revolving contact-points board in a predetermined direction and generates a signal, terminals coupled respectively to each of the elastic contact-points for leading the signals out, and an oblong hole the inner diameter of which is horizontally elongated in the predetermined direction; a pillar shaft fitting revolvable to the center hole of revolving contact-points board and being inserted in the oblong hole of fitting substrate; a sliding plate fixed to the pillar shaft and disposed horizontally-slidable in the predetermined direction under the fitting substrate; and a spring for horizontally pushing the revolving contact-points board and the sliding plate in the predetermined direction.

In the above described structure, the section of switch function is disposed within inside of the revolving contact-points board and the horizontal motion of revolving contact-points board is regulated by the sliding plate disposed under the fitting substrate. Therefore, the above rotary-operation type electronic component having push switch may have a reduced overall size both in the height and the length.

DESCRIPTION OF THE PREFERRED EMBODIMENTS

Exemplary embodiments of the present invention are described in the following with reference to drawings, using a rotary encoder with built-in push switch as the vehicle.

Embodiment 1

Figure 1:
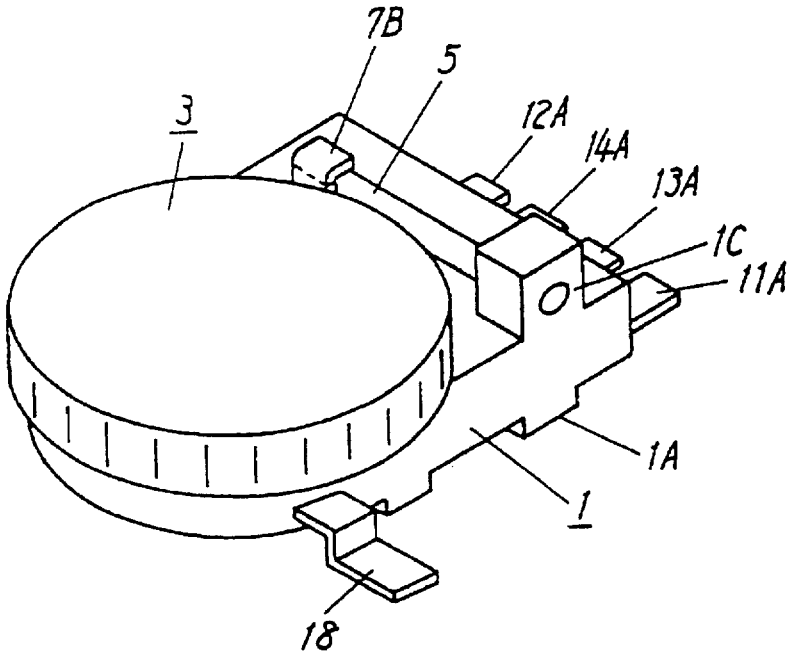
FIG.1 is a perspective view of a rotary encoder with push switch in accordance with a first exemplary embodiment of the present invention.
Figure 2:
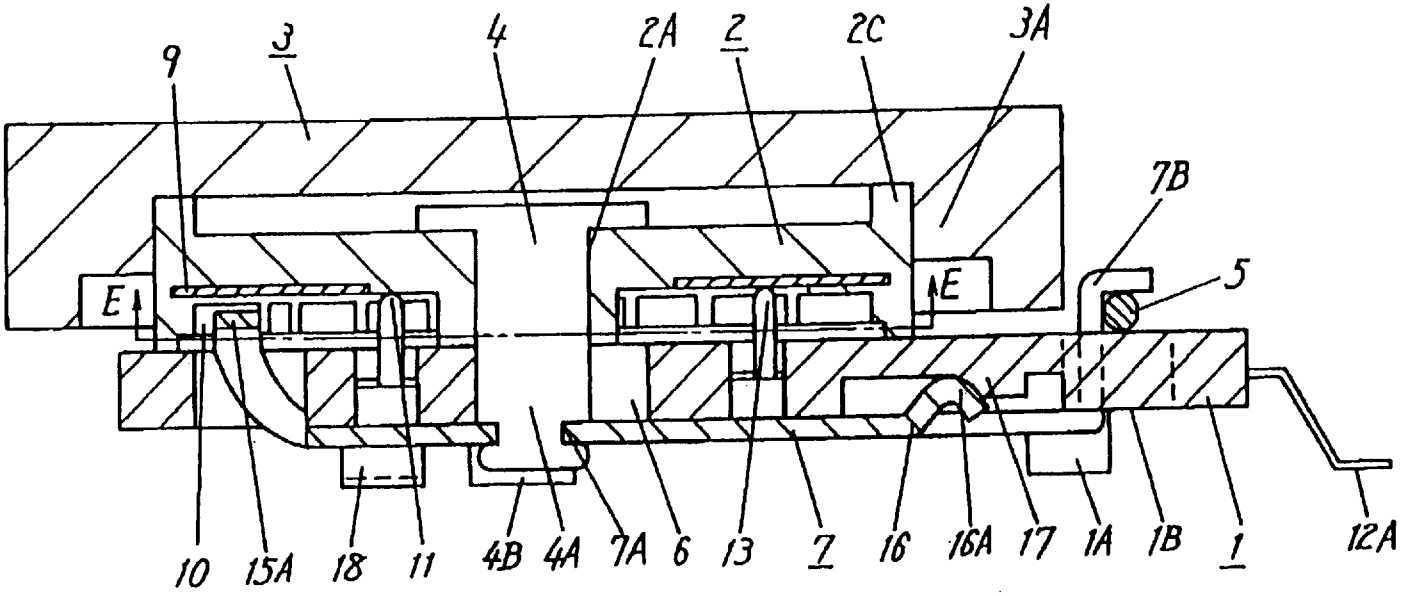
FIG.2 is a cross sectional side elevation of the encoder of FIG. 1.

In a rotary encoder with push switch of embodiment 1 as shown in FIG. 1 and FIG. 2, a revolving contact-points board 2, which functions as movable contact-points for the rotary encoder and the push switch, is attached on a fitting substrate 1, whose function being fixed contact-points. The revolving contact-points board 2 is provided with a round operation knob 3 fixed on it for driving, and is held revolvable by a pillar shaft 4 inserted through a center hole 2A. The revolving contact-points board 2 is slidable in a horizontal direction too on the fitting substrate 1 in the front-rear direction, and is being pushed to the front by a push back spring 5.

Figure 3:
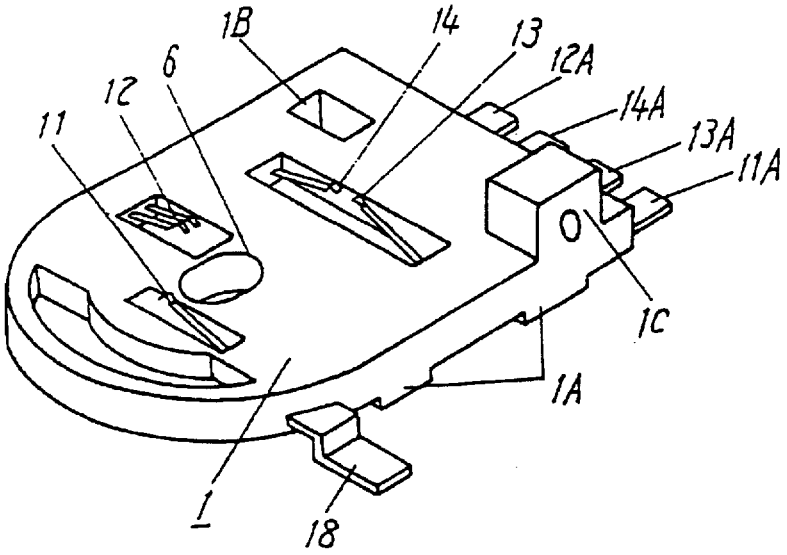
FIG.3 is a perspective view of a fitting substrate used in the encoder of FIG.1.
Figure 4:
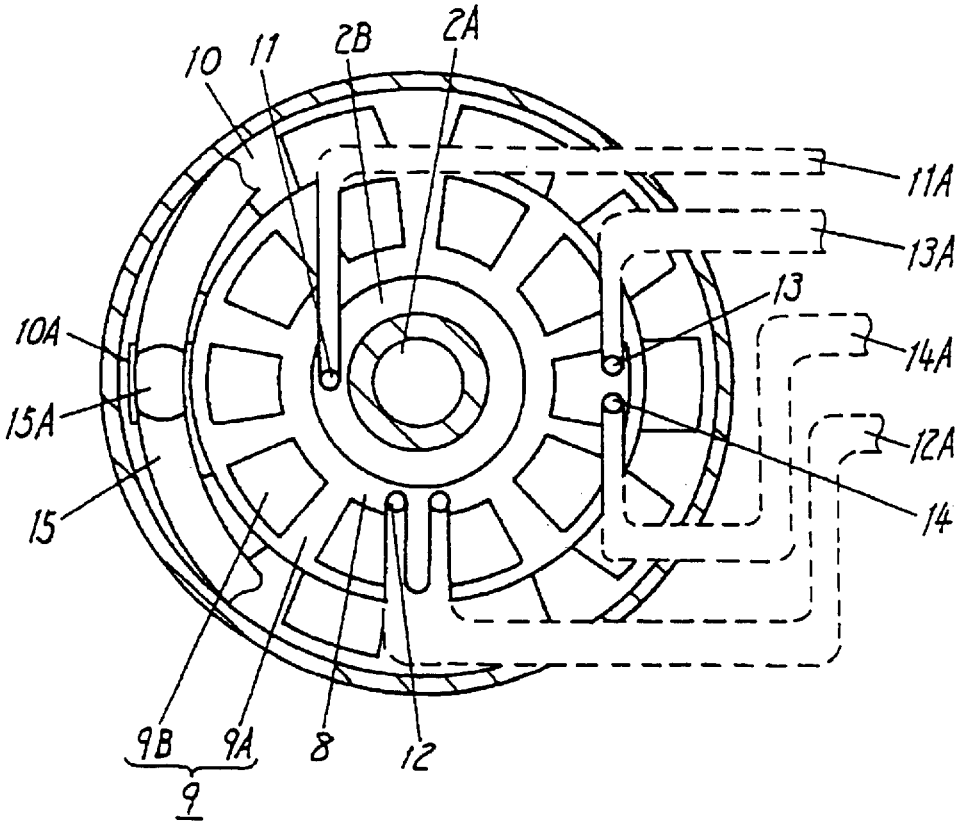
FIG.4 is a cross sectional view of the encoder of FIG.2 at line E—E.
Figure 5:
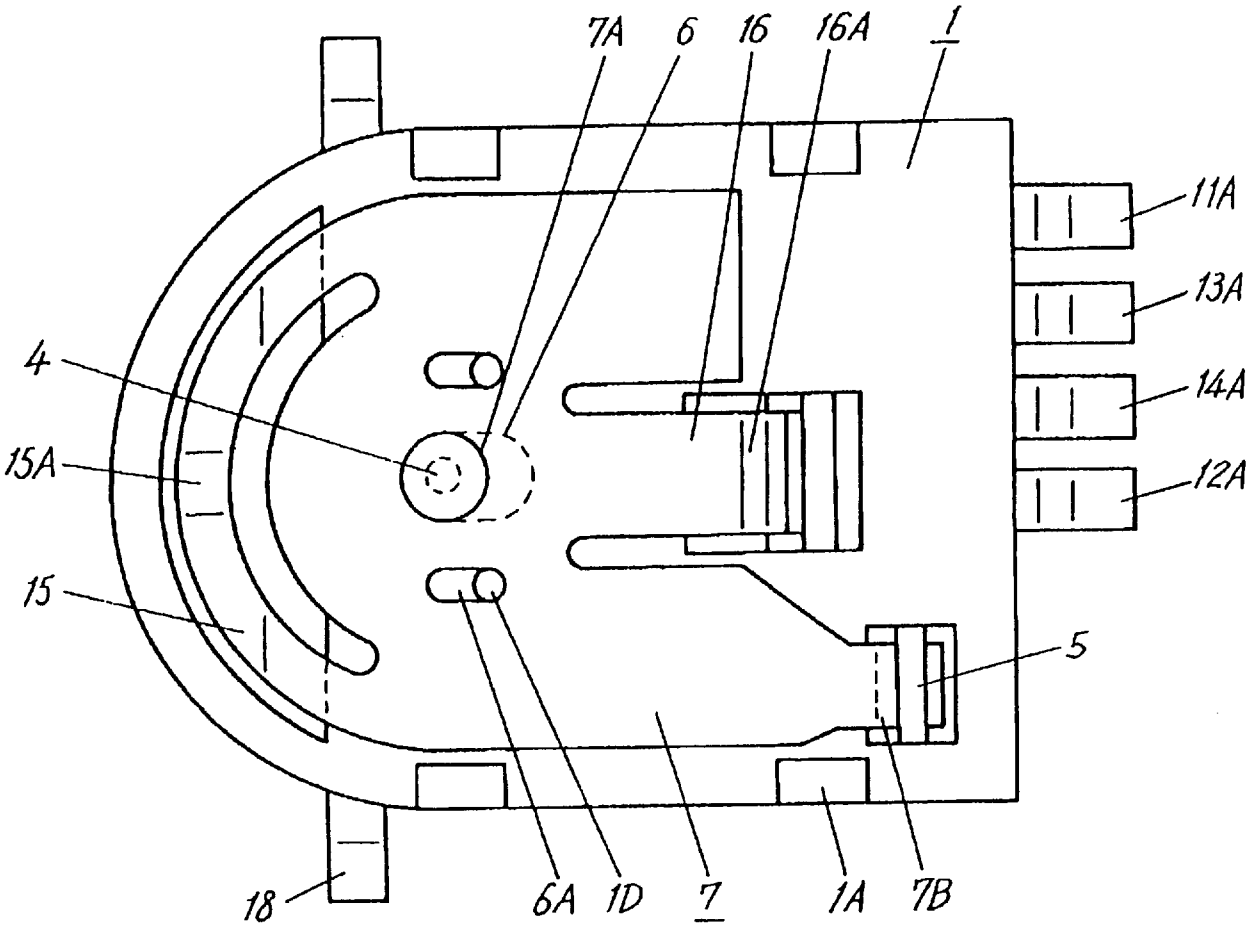
FIG.5 is a bottom view of the encoder of FIG.1.

The fitting substrate 1 is a flat board made of resin, shaped round at one end and square at the other end, as shown in FIG. 3. The fitting substrate 1 has an oblong hole 6 penetrating through the upper to the lower surfaces, the oblong hole 6 locating at the radial center of the round portion with the inner diameter expanding along the line connecting the center and the middle point of width of the square portion, and is provided with pedestals 1A on the bottom surface for determining the mounting height and mounting feet 18 for soldering onto a circuit board of an appliance. The foot 4A of pillar shaft 4 is inserted through the oblong hole 6 to be slidable along the line of major diameter, and the bottom end 4B is caulked into the center hole 7A of sliding plate 7 made of an elastic thin metal sheet disposed along the bottom surface of fitting substrate 1. The sliding plate 7 is attached on the fitting substrate 1 with the rear part 7B passing through a through hole 1B, the rear part 7B extruding above is being pushed back by the push-back spring 5 mounted in a spring holder 1C provided in the square portion. By the force of push-back spring 5, the foot 4A of pillar shaft 4 is usually pressed to the front wall of oblong hole 6.

On the bottom surface of revolving contact-points board 2 made of a resin disk, a ring contact-point 8 is provided around the center hole 2A with an insulating portion 2B of ring shape in between, and a radial contact-point 9 having comb contact-point 9A electrically connected with the ring contact-point 8 is provided outside the ring contact-point 8. On the bottom surface of revolving contact-points board 2 around the vicinity of outer circumference, radial bumps 10 are provided at the same pitch as the radial angle of the radial contact-point 9. In the normal state, an elastic contact-point 11 for switch disposed on the fitting substrate makes contact with the insulating portion 2B of revolving contact-points board 2, and a common contact-point 12 positioned perpendicular to the elastic contact-point 11 for switch makes contact with the ring contact-point 8. Two elastic contact-points 13, 14 for encoder provided with a certain gap to each other at the vicinity of the center line of fitting substrate 1 in the square portion are to make contact with the radial contact-point 9. At the edge of the square portion of fitting substrate 1, signal terminals 11A, 12A, 13A and 14A are provided coupling respectively with the elastic contact-points 11, 12, 13 and 14. A dowel 15A at the tip end of elastic foot 15 protruding from the sliding plate 7 in line with the center line of major diameter of oblong hole 6 at the edge of the round portion is contacting onto the radial bumps 10 of revolving contact-points board 2. In the normal state, the revolving contact-points board 2 makes a stop at a place where the dowel 15A rests in an indent 10A of the radial bumps 10. In this state of revolution, either of the elastic contact-points 13, 14 for encoder stay in an OFF region 9B of radial contact-point 9 where the comb contact-point 9A does not exist. When the revolving contact-points board 2 is rotated, pulse signal is generated as a result of on/off contacts between the contact-points 13, 14 for encoder and the comb contact-point 9A. For obtaining a certain difference in the phase between the respective pulse signals generated at the contact-points 13, 14, the location of the two contact-points 13, 14 on the OFF region 9B has been shifted for a certain specific angle.

At both sides of the center hole 7A of sliding plate 7, oblong guide holes 6A the inner diameter of which is expanding in the same direction as the oblong hole 6 are provided, to which guide holes 6A protrusions 1D from fitting substrate 1 are fitted in. These fittings contribute to regulate the horizontal motion of the revolving contact-points board 2 and the sliding plate 7 linked together with the pillar shaft 4 to the direction of center line of the oblong hole 6 in a smoother manner as compared with a case where there is only the oblong hole 6. On the bottom surface of fitting substrate 1, a protrusion 17 is provided in the square portion on the center line of oblong hole 6 for engagement with a dowel 16A provided at the tip end of elastic foot 16 for switch formed as a part of the sliding plate 7, in order to offer a click feeling during the horizontal movement.

The main portion of the encoder is structured as described above. The round operation knob 3 is installed by fitting the upper circumference of cylindrical part 2C of revolving contact-points board 2 to the inner circumference of cylindrical part 3A of operation knob 3. By designing the operation knob 3 detachable to and from the revolving contact-points board 2, any operation knob 3 of various sizes and shapes may be installed to a certain standard main body. Thus, various models of rotary encoders with push switch that best suit to specific application requirements may be presented at an inexpensive cost.

Operation of the rotary encoder with push switch is described in the following.

In the first place, operation of the encoder is described. When a force is applied at an edge 3B of the operation knob 3 in the tangential direction as indicated with an arrow in FIG.6, the operation knob 3 revolves around the pillar shaft 4. The common contact-point 12 slides on the ring contact-point 8, while two elastic contact-points 13, 14 for encoder slide on the radial contact-point 9 from OFF region 9B to comb contact-point 9A. As a result, pulse signal is generated in accordance with the revolution of operation knob 3. The dowel 15A provided at the tip end of elastic foot 15, which was staying in an indent 10A of radial bumps 10 slides over the radial bumps 10 with a click feeling to the next indent, or a stop position. The two elastic contact-points 13, 14 for encoder stop at other OFF region of the radial contact-point 9.

Figure 7:
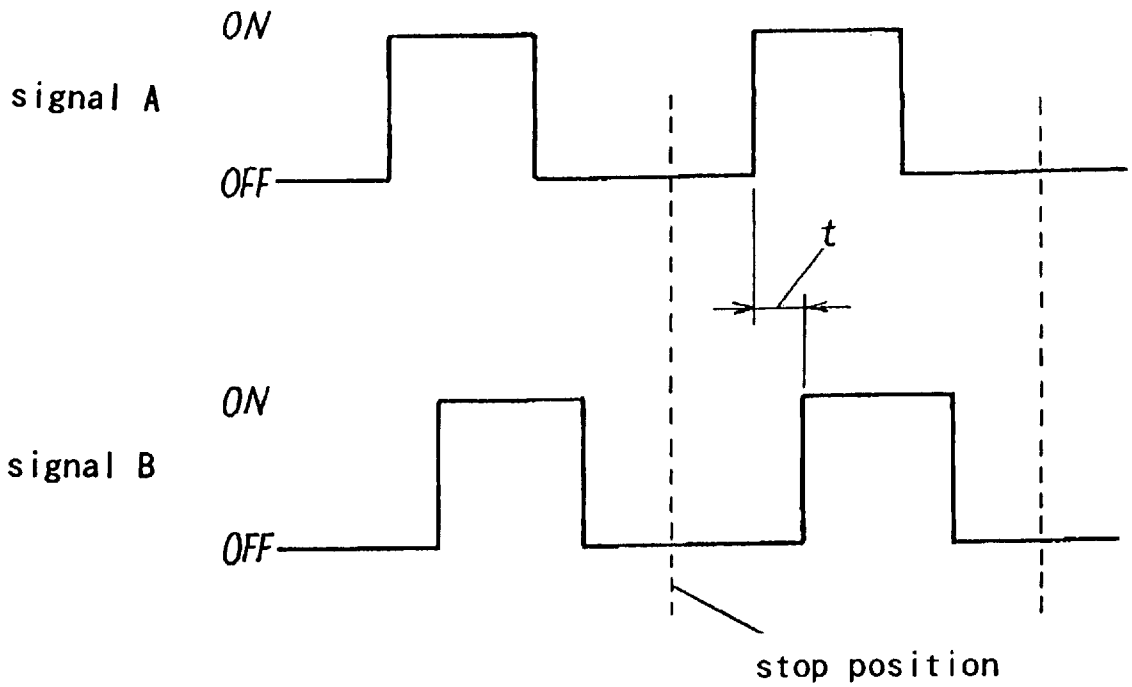
FIG.7 is a wave-form chart showing generation of pulse signal by the rotating operation illustrated in FIG.6.

The pulse signal thus generated is transmitted via common terminal 12A and terminals 13A, 14A on fitting substrate 1 to a circuit of an appliance. There is a phase difference t, as shown in FIG. 7, between the pulse signal A generated between common contact-point 12 and encoder contact-point 13 and the pulse signal B generated between common contact-point 12 and encoder contact-point 14. The revolving direction of encoder is known by detecting the phase difference t.

Figure 8:
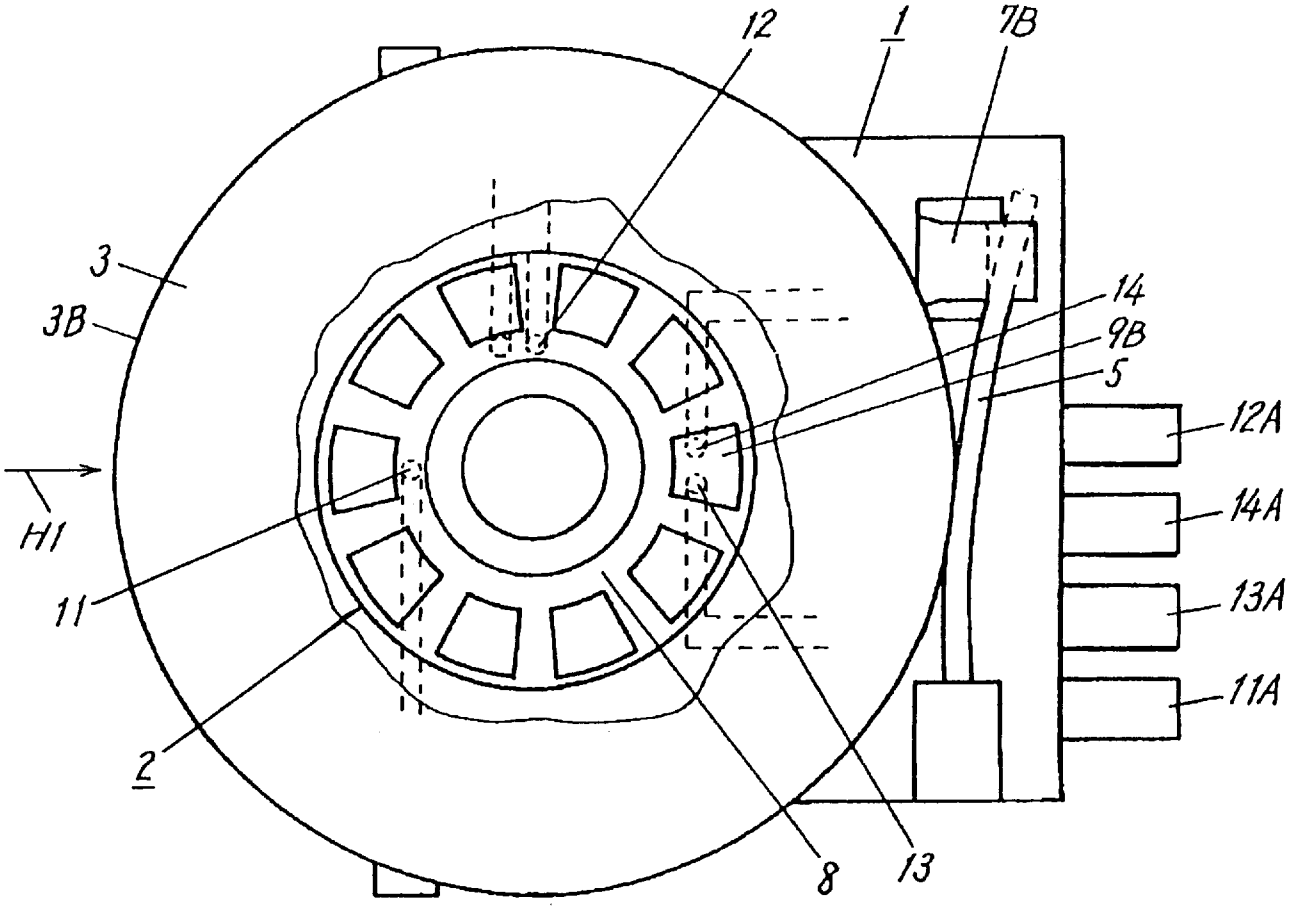
FIG.8 is a partially cut-away plane view of the encoder of FIG.1, used for explaining the horizontal operation.

Now in the following, operation of the push switch is described. When the operation knob 3 is pushed at an edge 3B in horizontal direction (direction H1), as shown in FIG. 8, against the spring force of push-back spring 5 which pushes revolving contact-points board 2 and sliding plate 7, the revolving contact-points board 2 and the sliding plate 7 move to the rear. When, a dowel 16A at the tip end of an elastic foot 16 of the sliding plate 7 rides over the protrusion 17 on the bottom surface of fitting substrate 1 accompanying a click feeling (see FIG.2). The elastic contact-point 11 for switch slides on the bottom surface of revolving contact-points board 2 to make contact with the ring contact-point 8. As a result, the common contact-point 12 and the contact-point 11 for switch are electrically coupled via ring contact-point 8 to make up a state of switch ON, and the signal is transmitted to a circuit of an appliance via common terminal 12A and terminal 11A.

Figure 6:
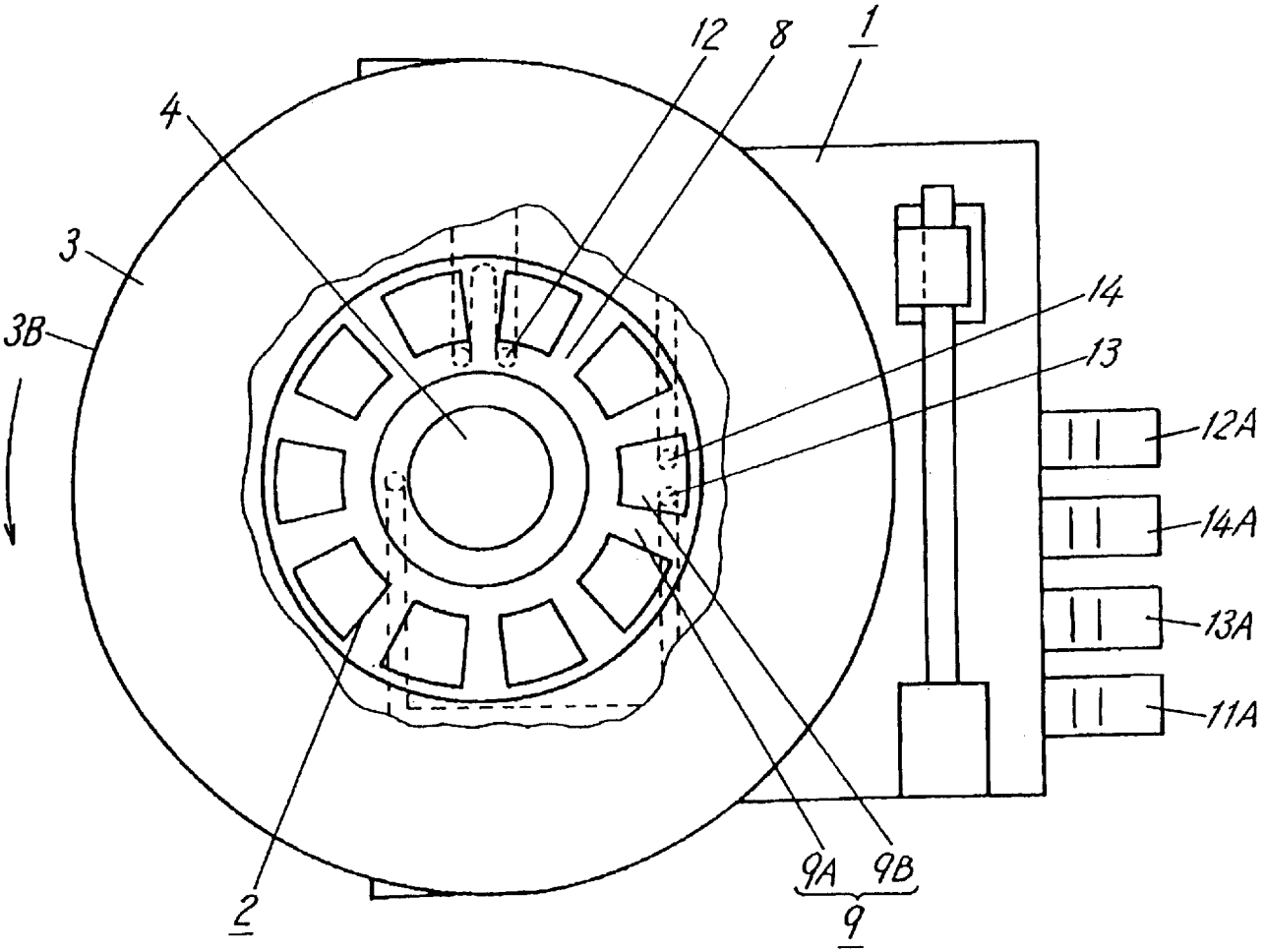
FIG.6 is a partially cut-away plane view of the encoder of FIG.1, used for explaining the rotating operation.

As soon as the pushing force given to operation knob 3 is withdrawn, the sliding plate 7 and the revolving contact-points board 2 are pushed back to the front by the elastic force of push-back spring 5, the dowel 16A rides over the protrusion 17 again with a click feeling. The elastic contact-point 11 for switch parts from the ring contact-point 8 making a state of switch OFF. The initial state as shown in FIG. 6 is restored.

As described in the above, during the time when operation knob 3 is being pushed in to perform the function of push switch the revolving contact-points board 2 does not revolve because the dowel 15A of sliding plate 7 is resting in an indent 10A of radial bumps 10. The two elastic contact-points 13, 14 for encoder are staying in the OFF region 9B of radial contact-point 9, and the place of stay is located close to the center line of oblong hole 6 in the major radius. Therefore, the moving direction of revolving contact-points board 2 is almost identical to the radial direction of radial contact point 9. As there is enough margin in the OFF region 9B at which the contact-points are contacting, there is little possibility for the encoder to generate erroneous signal. As the movable contact-point, with which the elastic contact-point 11 for switch is to make contact, is a ring-shaped contact-point 8, the switching operation may be conducted at any position regardless of stop position of revolving contact-points board 2. As the ring contact-point 8 and the radial contact-point 9 are electrically coupled together, the ring contact-point 8 may be used as the common contact-point for encoder and push switch.

As described in the above, a rotary encoder with push switch in accordance with the present exemplary embodiment has been formed with a reduced number of constituent components, and the structure fits to the assembly in bulk. Therefore, the present invention may offer a rotary encoder with push switch that is inexpensive and compact in the sizes of depth and height.

Although in the above description the ring contact-point 8 and the common elastic contact point 12, terminal 12A are used as the common contact-point for the encoder and the push switch, it is also possible to provide another ring contact-point dedicated to push switch to offer an encoder and a push switch electrically independent. It is also possible to provide a ring contact-point 8 outside, instead of inside, the radial contact-point 9, and dispose the elastic contact-point 11 for push switch somewhere in the square portion of fitting substrate 1 for contact with the ring contact-point disposed outside.

Embodiment 2

Figure 9:
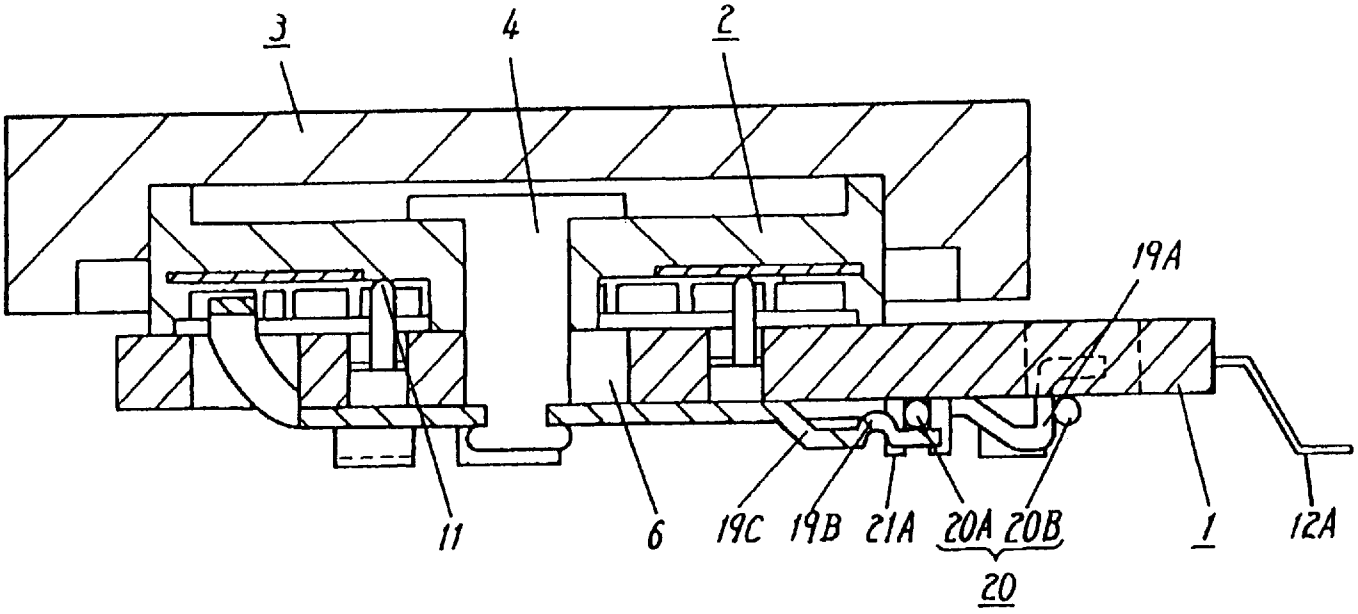
FIG.9 is a cross sectional side elevation of a rotary encoder with push switch in accordance with a second exemplary embodiment of the present invention.
Figure 10:
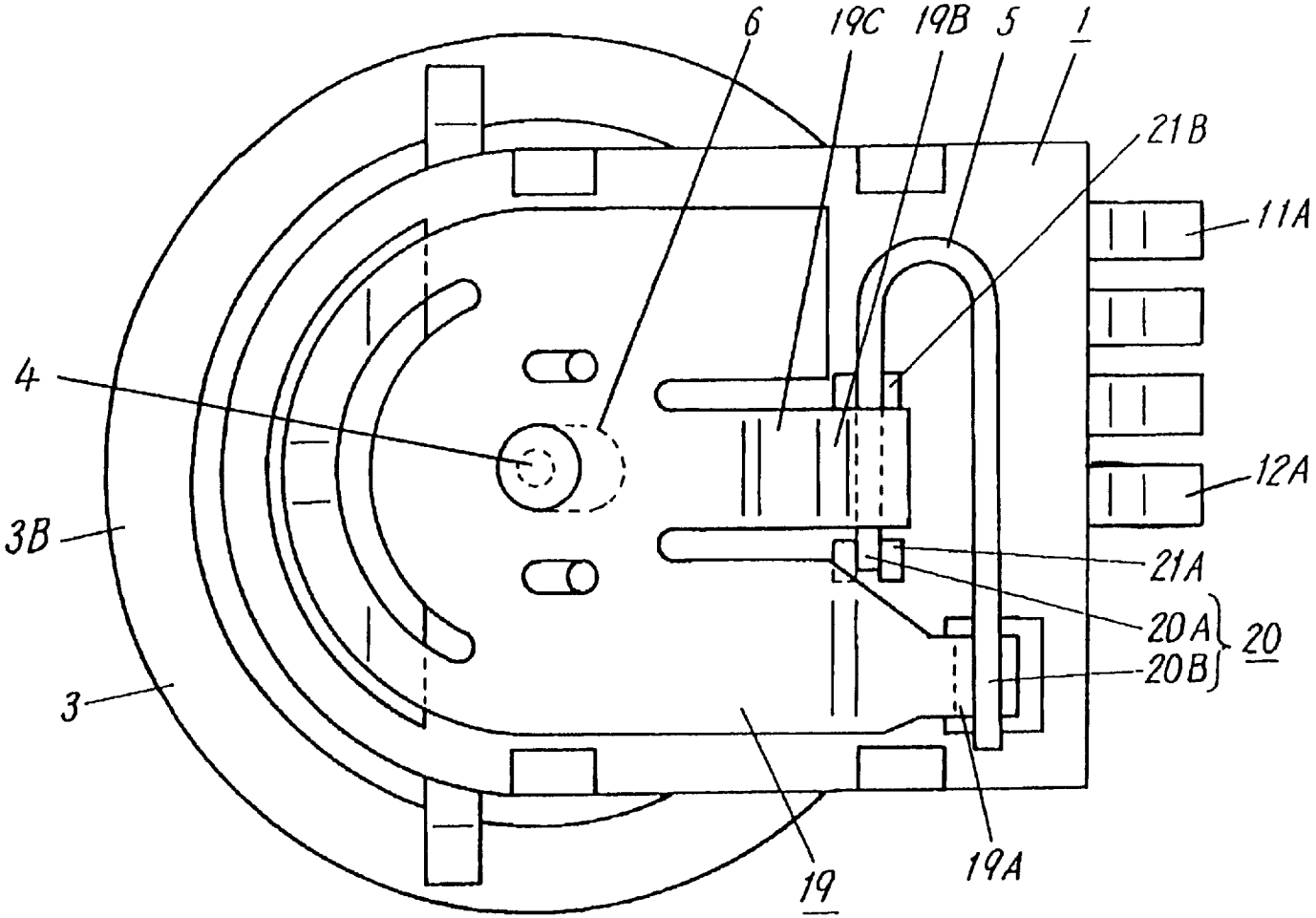
FIG. 10 is a bottom view of the encoder of FIG.9.
Figure 11:
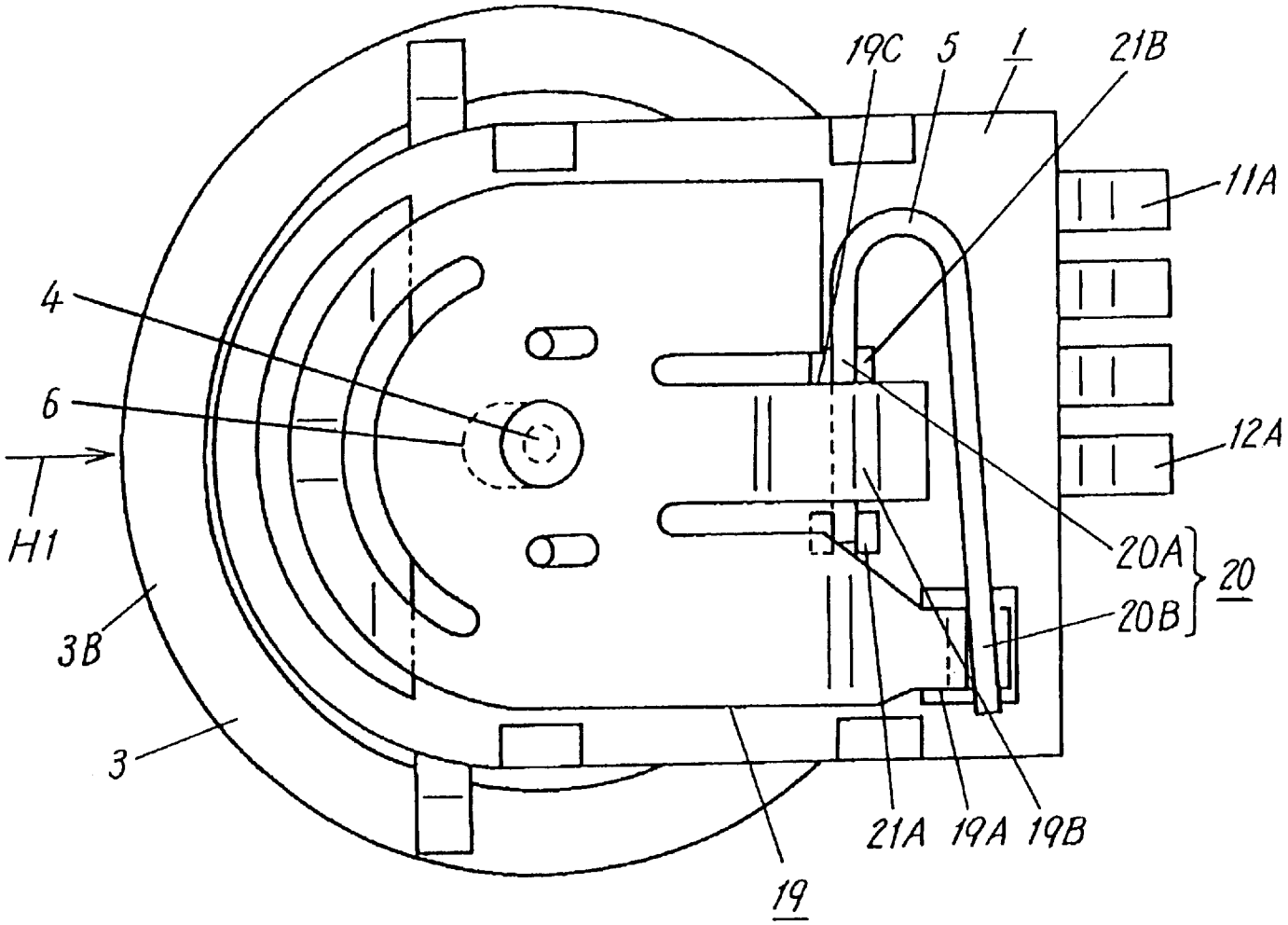
FIG.11 is a bottom view of the encoder of FIG.9 used for explaining the horizontal operation.
Figure 12:
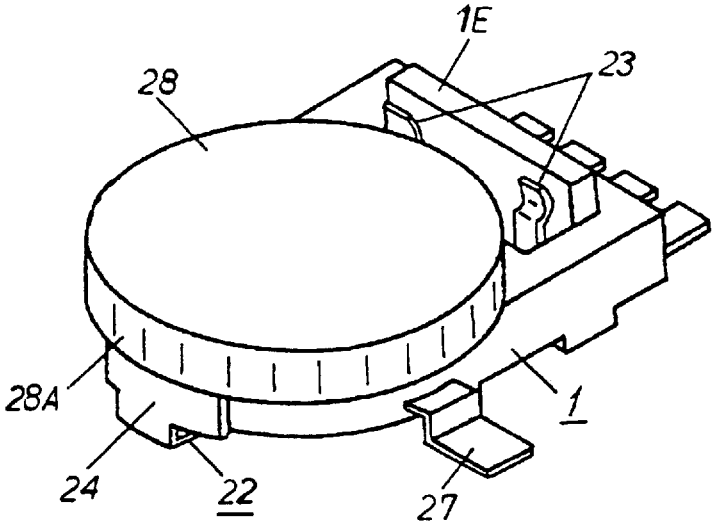
FIG. 12 is a perspective view of a rotary encoder with push switch in accordance with a third exemplary embodiment of the present invention.
Figure 13:
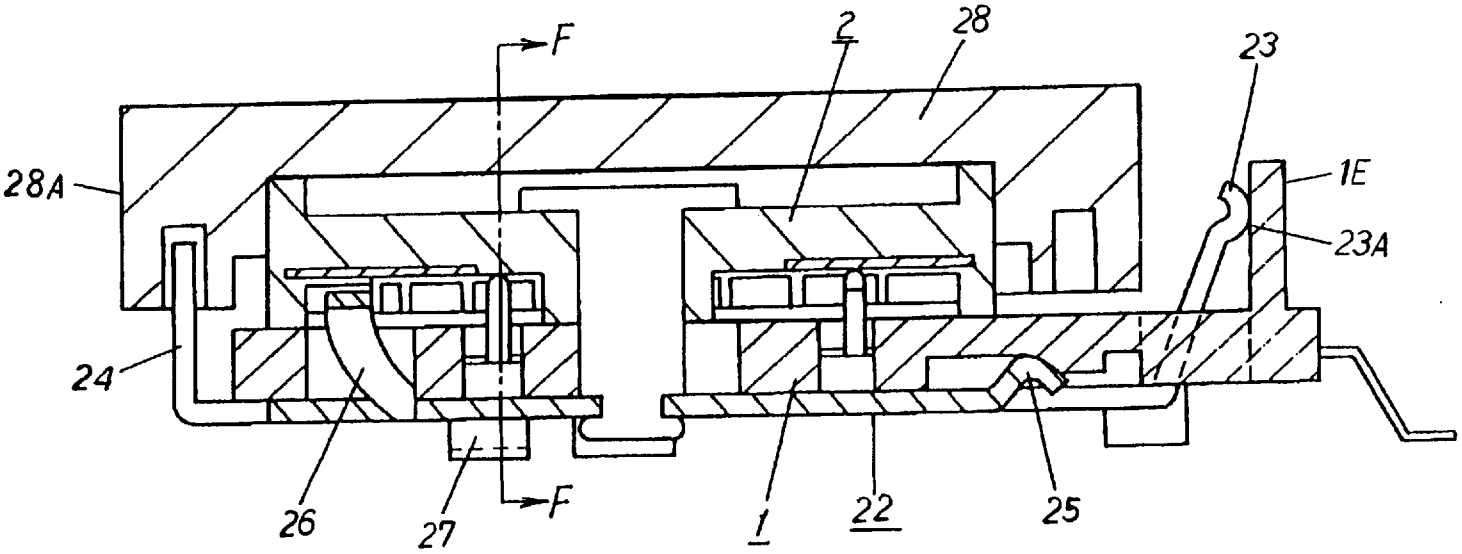
FIG.13 is a cross sectional side elevation of the encoder of FIG. 12.
Figure 14:
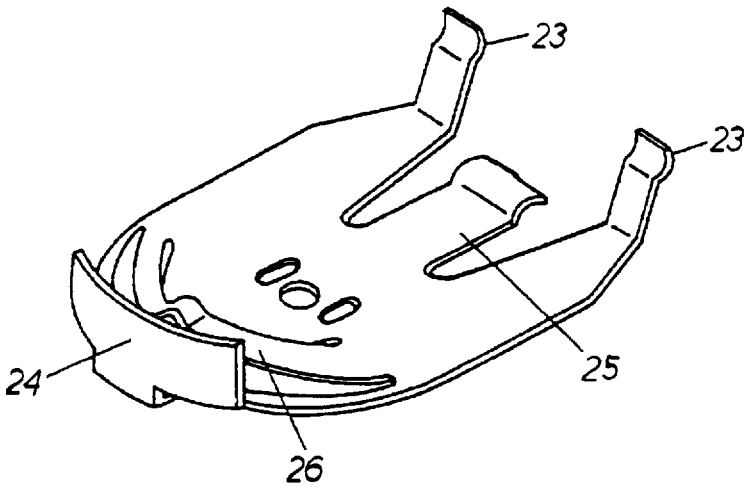
FIG.14 is a perspective view of a sliding plate used in the encoder of FIG.12.

A rotary encoder with push switch in accordance with the present exemplary embodiment 2, shown in FIG. 9–FIG. 11, is different from that of embodiment 1 in the following points. A U-shape spring 20 made of an elastic metal round wire is used for the spring member for pushing the revolving contact-points board 2 and the sliding plate 19 to the front, which spring 20 being disposed on the reverse surface of fitting substrate 1. One arm 20A is held by two holding parts 21A, 21B formed as part of the fitting substrate 1, while the other arm 20B is left as free end. The sliding plate 19 made of an elastic metal sheet is comprised of a rigid up-lifted part 19A and an elastic foot 19C. The up-lifted part 19A is touching the arm 20B to push it, thereby the sliding plate 19 is pushed to the front on the fitting substrate 1. The elastic foot 19C, together with a dowel 19B at the tip end, is attached between the holding part 21A and the holding part 21B so as to press the outer surface of arm 20A onto the fitting substrate 1.

The switch operation of the rotary encoder with push switch is described in the following. The rotary operation of which remains the same as in embodiment 1, therefore whose description is omitted here.

When the operation knob 3 is pressed at the edge 3B with a force in the horizontal direction H1 resisting against the spring force of U-shape spring 20, the revolving contact-points board 2 and the sliding plate 19 move to the rear. The arm 20B is pushed to open by the up-lifted part 19A, the elastic foot 19C slides over the outer surface of arm 20A, and the elastic dowel 19B rides over the arm 20A. When, the elastic contact-point 11 for switch slides on the bottom surface of the revolving contact-points board 2 to make contact with the ring contact-point 8 accompanying a click feeling. The elastic common contact-point 12 and the elastic contact-point 11 for switch are coupled via ring contact-point 8 to create a state of switch ON. Thus the signal is transmitted through common terminal 12A and terminal 11A to a circuit of an appliance.

As soon as the pushing force applied to operation knob 3 is removed, the sliding plate 19 and the revolving contact-points board 2 are pushed back to the front by the elastic restoration force of U-shape spring 20, the elastic dowel 19B rides over the arm 20A with a click feeling. The elastic contactpoint 11 for switch parts from the ring contact-point 8 creating a state of switch OFF.

As described above, the present embodiment 2 is structured to generate a click feeling when the elastic dowel 19B provided on the elastic foot 19C rides over the arm 20A. This offers a clear-cut feeling of click for a long duration of service with least deterioration.

Embodiment 3

A rotary encoder with push switch in accordance with the present exemplary embodiment 3, shown in FIG. 12–FIG. 15, is different from that of embodiment 1 in the following points. Namely, in embodiment 3, the revolving contact-points board 2 and the sliding plate 22 are pushed to the front on the fitting substrate 1 by a pair of push-back spring portions 23, and a shield plate 24 is provided in addition.

The push-back spring portions 23 are formed as part of the sliding plate 22 made of an elastic metal sheet at both sides of an elastic foot 25 for switch in the rear portion. Dowels 23A formed at the tip end of push-back spring portions 23 touch against an wall 1E of fitting substrate 1 for keeping the sliding plate 22 pressed to the front.

Figure 15:
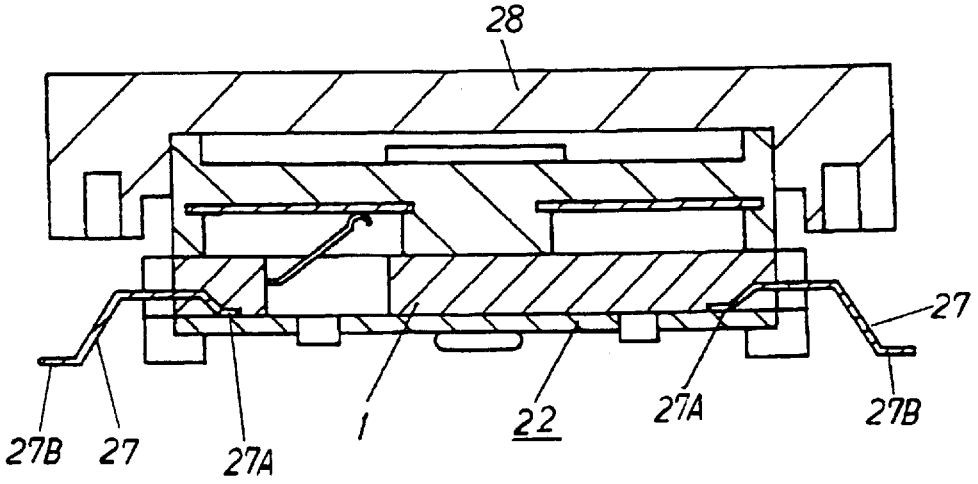
FIG. 15 is a cross sectional view of the encoder of FIG. 13 at line F—F.
Figure 16:
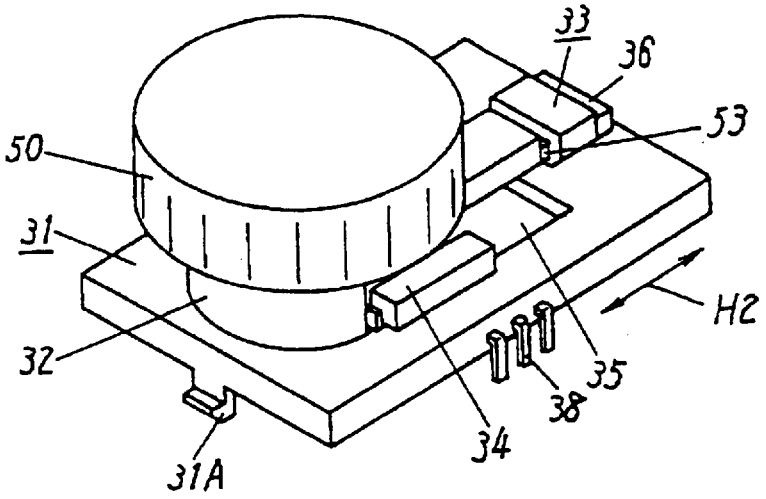
Fig. 16 PRIOR ART
FIG.16 is a perspective view of a conventional rotary encoder with push switch.
Figure 17:
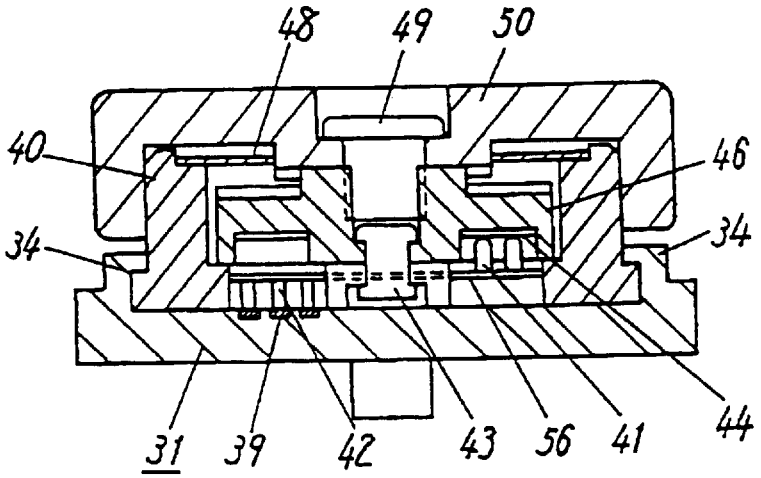
Fig. 17 PRIOR ART
FIG.17 is a cross sectional front elevation of the conventional encoder of FIG.16.
Figure 18:
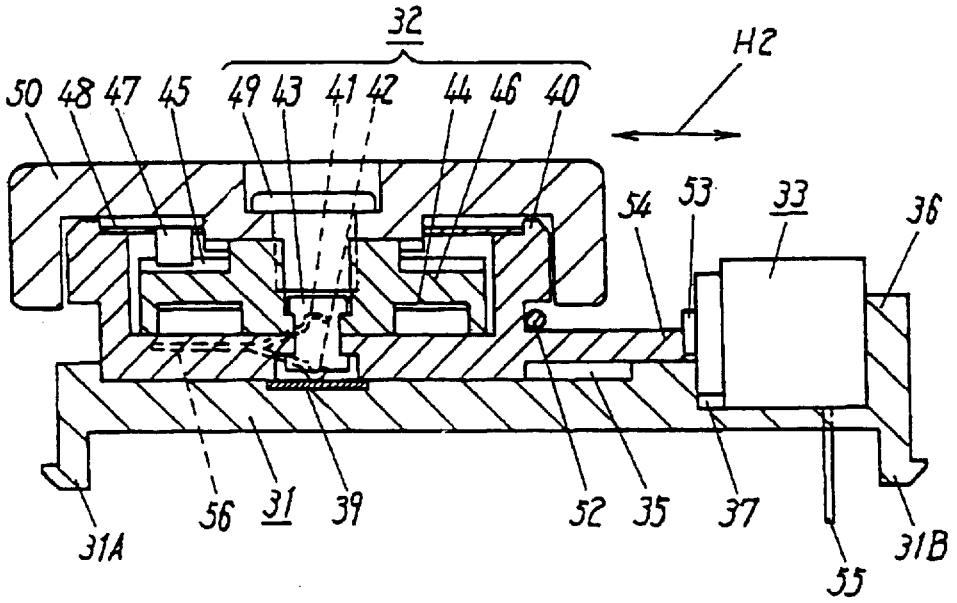
Fig. 18 PRIOR ART
FIG. 18 is a cross sectional side elevation of the conventional encoder of FIG.16.
Figure 19:
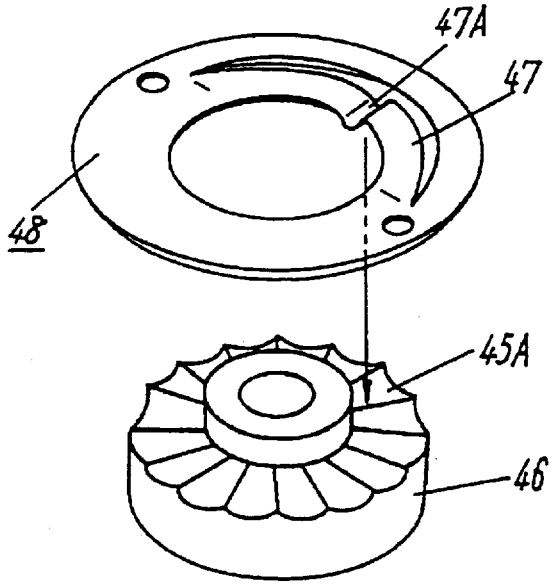
Fig. 19 PRIOR ART
FIG.19 is a perspective view of a rotary disk and a clicking spring used in the conventional encoder of FIG.16, used for explaining the mutual relationship between the two items.
Figure 20:
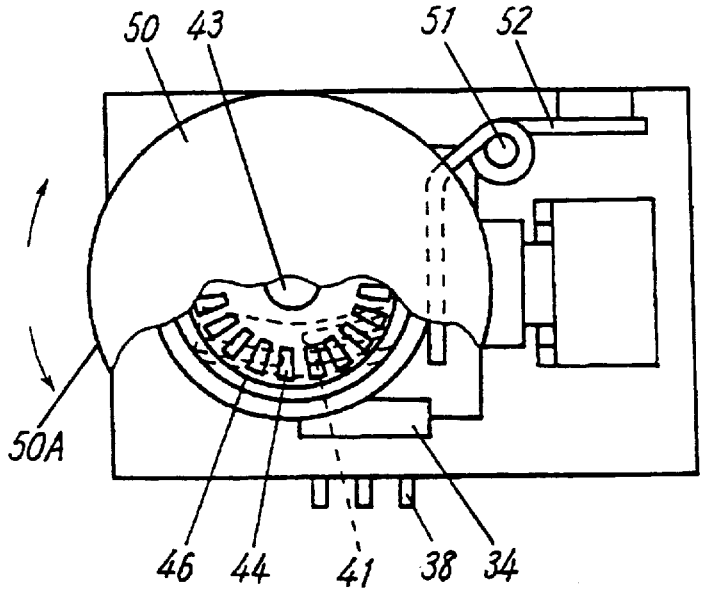
Fig. 20 PRIOR ART
FIG.20 is a partially cut-away plane view of the conventional encoder of FIG. 16, used for explaining the rotating operation.
Figure 21:
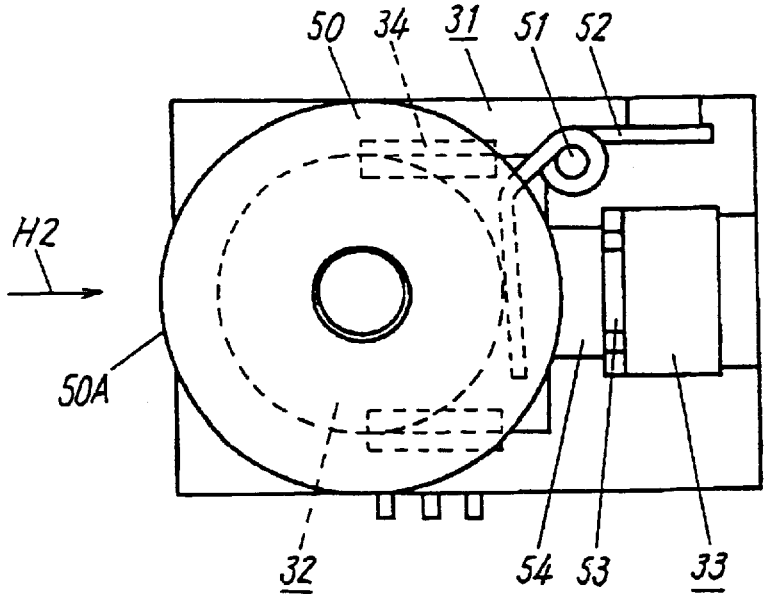
Fig. 21 PRIOR ART
FIG.21 is a partially cut-away plane view of the conventional encoder of FIG. 16, used for explaining the horizontal operation.

The shield plate 24 having a curved shape is provided for separating the operating edge 28A of circular operation knob 28 from a live current portion consisted of contact-points, etc. for encoder and push switch for shielding one another, and is formed as a part of the sliding plate 22 at the front of elastic foot 26. The shield plate 24 is disposed between the operating edge 28A and the live current portion. The static electricity generated when the operating edge 28A is manipulated with the finger is discharged via contact surfaces 27B to the grounding circuit of an appliance, through the shield plate 24, flat part of the sliding plate 22, and current collecting portions 27A of mounting feet 27 on the bottom surface of fitting substrate 1, as shown in FIG.15.

As described in the above, the push-back spring portions 23 and the sliding plate 22 are unitized into a component of one single body in the embodiment 3. Thus the components count has been reduced to further less. And the additionally provided shield plate 24 contributes to prevent the influence of static electricity which may be generated during operation.

Although the present invention has been described in terms of the presently preferred embodiments 1–3, various alterations and modifications will no doubt become apparent to those skilled in the art after having read the above disclosure. For example, although descriptions were made with respect to a rotary encoder for representing the rotary-operation type electronic component, the present invention may be embodied also in a rotary variable resistor. Accordingly, it is intended that the appended claims be interpreted as covering all alterations and modifications as fall within the true spirit and scope of the invention.

What is claimed is:

1. A rotary-operation type electronic component with push switch comprising:

a revolving contact-points board provided with a plurality of contact-points disposed radially on a bottom surface and having a center hole at the center;

an operation knob for operating said revolving contact-points board;

a fitting substrate having an elastic contact-point for generating a revolution signal as a result of contact with said plurality of contact-points made by revolution of said revolving contact-points board, an elastic contact-point for generating a switch signal as a result of contact with said plurality of contact-points made by shift of said revolving contact-points board in a predetermined horizontal direction, terminals for leading the signals out coupled respectively with each of said elastic contact-points, and an oblong hole whose inner diameter is elongated in the predetermined horizontal direction;

a pillar shaft fitting revolvable to the center hole of said revolving contact-points board and inserted in the oblong hole of said fitting substrate;

a sliding plate fixed to said pillar shaft and attached slidably under said fitting substrate in the predetermined horizontal direction; and a spring for pushing said revolving contact-points board and said sliding plate in the predetermined horizontal direction.

2. The rotary-operation type electronic component with push switch recited in claim 1, wherein said plurality of contact-points comprise a ring contact-point and a comb contact-point electrically coupled with said ring contact-point and stretching radially outward or inward outside, or inside, and said elastic contact-point for generating said revolution signal comprises a first contact-point which is to make contact with said ring contact-point and a second contact-point which is to make contact with said comb contact-point, for generating a pulse signal therein.

3. The rotary-operation type electronic component with push switch recited in claim 2, wherein said second contact-point comprises two contact-points, for providing phase difference between the pulse signals generated by the respective contact-points.

4. The rotary-operation type electronic component with push switch recited in claim 3, wherein said two contact-points are disposed at a vicinity of a center line of said revolving contact-points board parallel to the predetermined horizontal direction.

5. The rotary-operation type electronic component with push switch recited in claim 2, wherein said elastic contact-point for generating said switch signal makes contact with said ring contact-point.

6. The rotary-operation type electronic component with push switch recited in claim 1, wherein said revolving contact-points board is provided with radial bumps concentric to said plurality of contact-points, and a foot having a dowel at a tip end to touch said radial bumps is formed from an elastic metal sheet as a part of said sliding plate.

7. The rotary-operation type electronic component with push switch recited in claim 6, wherein said plurality of contact-points comprise a radial contact-point, said radial bumps are provided at a same pitch angle as said radial contact-point, and said elastic contact-point for generating said revolution signal makes contact with an OFF region of said radial contact-point when said dowel is set in an indent of said radial bumps.

8. The rotary-operation type electronic component with push switch recited in claim 1, wherein said plurality of contact-points comprise a ring contact-point, and said elastic contact-point for generating said switch signal makes contact with said ring contact-point.

9. The rotary-operation type electronic component with push switch recited in claim 1, wherein said fitting substrate is provided with bumps on a bottom surface, and a foot having a dowel at a tip end to engage with said bumps is formed from an elastic metal sheet as a part of said sliding plate.

10. The rotary-operation type electronic component with push switch recited in claim 1, wherein said spring is made of an elastic metal wire shaped into a letter U to form a pair of arms, two holding parts are provided on a bottom surface of said fitting substrate for holding the spring, an elastic foot having an up-lifted part and an elastic dowel is formed from an elastic metal sheet as a part of said sliding plate, one arm of said pair of arms is held by said two holding parts while the other arm is held free, said up-lifted part is touching said other arm to open the other arm, and said elastic dowel is disposed over an outer surface of said one arm at an area between said two holding parts so as a click feeling is obtainable when said revolving contact-points board is moved in a horizontal direction to open the other arm by a force resisting against that of said spring.

11. The rotary-operation type electronic component with push switch recited in claim 1, wherein said spring is formed from an elastic metal sheet as a part of said sliding plate.

12. The rotary-operation type electronic component with push switch recited in claim 1, wherein said operation knob has a round shape and is disposed so as the outer circumferential edge is positioned outside a live current portion comprising said plurality of contact-points and said elastic contact-points, and a shield provided between the outer circumferential edge of said operation knob and said live current portion is formed from an elastic metal sheet as a part of said sliding plate and is connected to an external grounding circuit.

13. The rotary-operation type electronic component with push switch recited in claim 1, wherein said operation knob is detachable to said revolving contact-points board.

14. The rotary-operation type electronic component with push switch recited in claim 1, wherein said sliding plate is provided with a guide hole whose inner diameter is elongated in the predetermined horizontal direction, while said fitting substrate is provided with a guide protrusion on a bottom surface for insertion to said guide hole.

* * * * *